United States Patent [19]

Susaki et al.

[11] 4,206,788

[45] Jun. 10, 1980

[54] METHOD FOR CONTROLLING FILLING RATE IN FILLING MACHINE

[75] Inventors: Akihiro Susaki, Wakayama; Noboru Tsuboki, Koshigaya; Kyoichi Amino, Saitama; Minoru Hosoya, Tokyo, all of Japan

[73] Assignee: Kao Soap Co., Ltd., Tokyo, Japan

[21] Appl. No.: 960,174

[22] Filed: Nov. 13, 1978

[30] Foreign Application Priority Data

Nov. 24, 1977 [JP] Japan ..... 52-140976

[51] Int. Cl.[2] ..... B65B 3/34

[52] U.S. Cl. ..... 141/1; 116/282; 137/556; 141/167; 198/855; 222/47; 250/223 B

[58] Field of Search ..... 116/281, 282; 137/551, 137/556; 141/1, 83, 94, 95, 96, 101, 144–152, 153, 177, 181, 392, 167, 266; 198/855; 222/47; 250/223 B

[56] References Cited

U.S. PATENT DOCUMENTS

| | | | |
|---|---|---|---|
| 2,796,195 | 6/1957 | Willis et al. | 222/47 X |
| 3,139,915 | 7/1964 | Minard | 141/94 |
| 3,789,890 | 2/1974 | Riedel | 141/144 |
| 3,871,509 | 3/1975 | Küster | 141/167 |
| 4,015,645 | 4/1977 | Chamberlin | 141/198 X |

*Primary Examiner*—Frederick R. Schmidt

*Attorney, Agent, or Firm*—Blanchard, Flynn, Thiel, Boutell & Tanis

[57] ABSTRACT

A method for controlling the rate of filling bottles as they are moved by a rotary table, in which position indicating devices are attached to the pistons which move the filling nozzles up and down in the vertical direction, the position indicating devices are detected just before the bottles are discharged from the rotary table to determine whether filling of the bottles is completed by means of two piston position detecting devices A and B which devices are circumferentially spaced-apart so as to define an included angle $\theta$ of 10° to 30° with respect to the center of the rotary table, and the rotation speed of the rotary table is increased or decreased so that the proportion of completely filled bottles detected by the first or leading detecting device A during each rotation of the rotary table is less than 100% but the proportion of completely filled bottles detected by the second or trailing detecting device B during each rotation of the rotary table is 100%.

3 Claims, 3 Drawing Figures

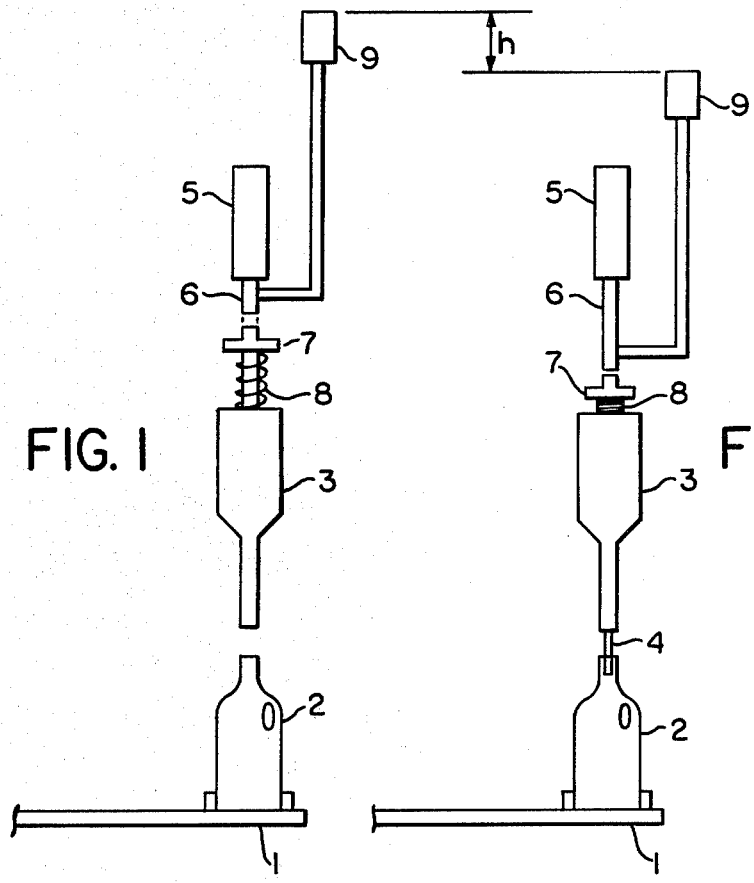
FIG. 1
FIG. 2
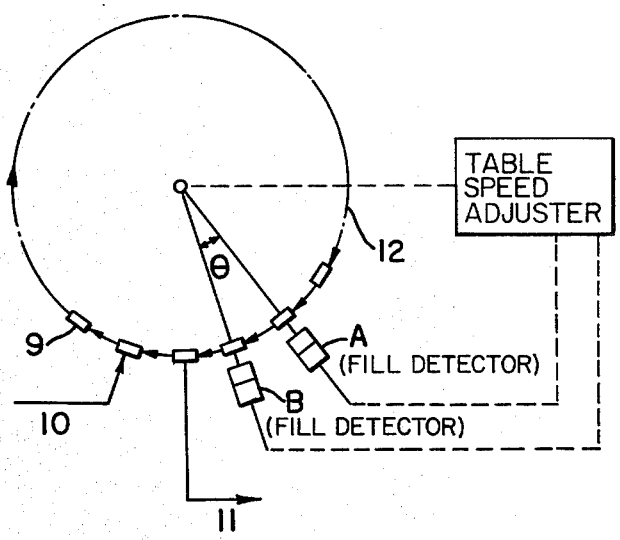
FIG. 3

METHOD FOR CONTROLLING FILLING RATE IN FILLING MACHINE

BACKGROUND OF THE INVENTION

1. Field of the Invention

The present invention relates to a method for controlling the filling rate in a filling machine. More specifically, the present invention relates to a filling method in which bottles are fed into a rotary table and a predetermined amount of a substance is filled in each bottle while the rotary table makes one rotation, said method being characterized by the features that just before withdrawing the filled bottles from the rotary table, the proportion of completely filled bottles is detected by two filling completion detecting devices defining a central angle $\theta$ of 10° to 30° with respect to the center of the rotary table and the rotation speed of the rotary table is increased or decreased based on the results of the detections.

2. Description of the Prior Art

According to conventional methods for filling liquids into bottles, bottles are fed onto a rotary table, filling nozzles are inserted into the bottles and filling is completed while the rotary table makes one rotation, and the filled bottles are withdrawn from the rotary table. If feeding of bottles to the rotary table and withdrawal of filling-completed bottles therefrom is continuously performed, a continuous filling operation becomes possible and the operation efficiency can be remarkably increased.

In most of the conventional filling machines, however, the rotation speed of the table is set at an appropriate level and the continuous filling operation is conducted at a constant speed without controlling or adjusting the operation speed during the filling operation which is continuously conducted. If the dimensions of the bottles and/or the physical properties of the liquid substance to be filled therein do not change, but rather remain uniform, and if the predetermined rotation speed corresponds substantially to the maximum capacity of the filling machine, no particular disadvantage is caused. However, because the viscosity or other physical characteristics of the liquid may change in response to changes of the ambient temperature or the like, it is necessary to provide a certain margin of safety when the rotation speed of the rotary table is set. In other words, it is difficult always to perform the operation at a rotation speed corresponding to the maximum filling capacity of the filling machine. For example, if the rotation speed of the rotary table is set too high, there will be a risk that the quantity of the liquid filled in the bottles will become too small when the ambient temperature becomes lower.

According to the present invention, it is possible always to perform the filling operation at the maximum filling capacity of the filling machine consistent with always completely filling the bottles with the required amount of liquid. An embodiment of the present invention will now be described by reference to the accompanying drawings.

BRIEF DESCRIPTION OF THE DRAWINGS

The drawings illustrate an embodiment of the present invention.

FIGS. 1 and 2 are side views diagrammatically illustrating the apparatus that is used in the present invention.

FIG. 3 is a schematic plan view diagrammatically illustrating the method of the present invention.

Referring to the drawings, FIG. 1 illustrates the positions of the parts just after feeding a bottle 2 onto the rotary table 1 of the filling machine 3. Although the filling machine 3 is fixed to the table 1, the fixing frame and the liquid supply pipe is omitted in the drawing. As the table 1 rotates, a filling nozzle 4 of the filling machine 3 is inserted into the bottle 2 (see FIG. 2), and a predetermined amount of a liquid is filled into the bottle 2. Lowering of the filling nozzle 4 is accomplished, for example, by lowering a piston 6 by means of an air cylinder 5 or the like and thereby pushing down the top end 7 of the filling nozzle 4 against a spring 8. A position indicating device 9 is mounted on the piston 6. Accordingly, during the filling operation, the position indicating device 9 is lowered by a vertical distance h.

FIG. 3 shows the path of travel of the position indicating devices 9 as they move with the rotary table. Arrow 10 indicates the bottle feeding position and arrow 11 indicates the position at which the completely filled bottle is withdrawn. Arrow 12 indicates the direction of the movement of the position indicating devices 9. The amount of filling of the bottles is detected just before the bottles are withdrawn from the table by detecting the positions of the position indicating devices 9 by means of two position detecting devices A and B. The position detecting devices A and B are circumferentially spaced apart so that imaginary radial lines extending from the axis of rotation of the table through said position detecting devices define an included angle $\theta$ of from 10° to 30°. Thus, whether or not filling of the bottles is completed is detected at the two positions of the devices A and B. Since the position indicating devices 9 are lowered by a height h as shown in FIG. 2, incomplete filling can easily be detected by a photoelectric tube or the like.

The numbers of completely filled bottles detected at the positions A and B are counted with respect to each rotation of the rotary table and the proportions of completely filled bottles obtained at the positions A and B are determined, that is, the number of bottles that are completely filled by the time they reach positions A and B, respectively, are compared to the total number of bottles filled by the machine. The ratio, expressed as a percentage, of the number of completely filled bottles at positions A and B, respectively, to the total number of bottles is the proportion (%) at positions A and B. Based on the thus-determined proportions of completely filled bottles, the rotation speed of the rotary table is controlled in a manner as indicated in the following Table.

Table

| Proportion (%) of Completely Filled Bottles | | Rotation Speed |
|---|---|---|
| Position A | Position B | of Rotary Table |
| 100 | 100 | increased |
| 95 or more | 100 | increased |
| below 95 | 100 | not changed |
| any proportion | below 100 | decreased |

When the rotation speed of the rotary table is controlled in the foregoing manner, the operation can be conducted at the maximum filling capacity of the filling machine under ambient conditions. Even if the viscosity and/or specific gravity of the liquid to be filled in the bottles is changed, by increasing or decreasing the rotation speed of the rotary table in response to such changes, the filling rate can be automatically controlled.

In this invention, a conventional filling nozzle assembly may be also used, which has an air-blowing nozzle for continuously blowing air and a liquid-introducing nozzle. At the beginning of the liquid-filling step, the nozzle assembly is set at the operative position wherein it is inserted into a bottle and filling of the liquid is started. While the liquid is introduced through the liquid-introducing nozzle, air is also continuously blown through in the other nozzle. At the time when the surface of the liquid filled in the bottle comes very close to, or otherwise in contact with, the end of the air-blowing nozzle, the pressure of the air increases accordingly, which is immediately detected by a detector. This sends a signal to stop filling of the liquid, whereby the filling nozzle is moved up to the non-filling position.

Such reciprocating motion of the filling nozzle may be conducted through a piston by means of an air cylinder. A piston in the air cylinder is provided with a vertically reciprocable position-indicating device, which is observed with a piston position-detecting device. The filling nozzle, the piston and the indicating device move up and down together. For example, the position-indicating device is a mirror and the position-detecting device is a photocell. In this example, the photocell detects the reflected radiation from the mirror.

The embodiments of the invention in which an exclusive property or privilege is claimed are defined as follows:

1. In a method controlling the filling rate of a rotary filling machine wherein bottles are placed onto a rotary table, vertically reciprocable filling nozzles are moved with the table and are inserted into the bottles while the bottles are moved along a circular path by rotation of the rotary table and a predetermined amount of a substance is filled from the nozzles into the bottles, said rotary filling machine having vertically reciprocable position indicating devices attached to the pistons that move the respective filling nozzles up and down in the vertical direction for indicating the amount of said substance present in the bottles, said method comprising the steps of: immediately prior to removing the respective filled bottles from the table, separately detecting the vertical positions of said position indicating device for each bottle by means of two piston position detecting devices A and B which are circumferentially spaced apart so as to define an included angle $\theta$ of from 10° to 30° with respect to the center of the rotary table to determine whether filling is completed in the bottle; and adjusting the rotation speed of the rotary table so that the proportion of completely filled bottles detected by the leading detecting device A during each rotation of the rotary table is less than 100% and so that the proportion of completely filled bottles detected by the trailing detecting device B during each rotation of the rotary table is 100%.

2. A method for controlling the filling rate in a filling machine according to claim 1 wherein when the proportion of completely filled bottles detected by the detecting device A is 95% or more and the proportion of completely filled bottles detected by the detecting device B is 100%, the rotation speed of the rotary table is increased, and when the proportion of completely filled bottles detected by the detecting device B is less than 100%, the rotation speed of the rotary table is decreased.

3. A method for controlling the operation of a machine for filling containers, said machine comprising a rotary table for supporting and moving containers and means for filling the containers as they move with the table which comprises the steps of: detecting the amounts of the contents of the containers at first and second circumferentially spaced locations, said second location being located close to the position at which the containers are discharged from the table and said first location being located circumferentially ahead of said second location a distance corresponding to an arc of from 10° to 30° of the circumference of the table, and adjusting the speed of rotation of the table so that less than 100% of said bottles are completely filled by the time they reach said first location and 100% of the bottles are completely filled by the time they reach said second location.

* * * * *